United States Patent [19]

Anderson

[11] Patent Number: 5,074,032

[45] Date of Patent: Dec. 24, 1991

[54] MODULAR PRESS TOOL FOR ASSEMBLING AND TERMINATING ELECTRICAL CONNECTORS

[75] Inventor: Daniel J. Anderson, Elmhurst, Ill.

[73] Assignee: Molex Incorporated, Lisle, Ill.

[21] Appl. No.: 646,133

[22] Filed: Jan. 25, 1991

[51] Int. Cl.[5] ..... H01R 43/04

[52] U.S. Cl. ..... 29/749; 29/753

[58] Field of Search ..... 29/749, 753, 751, 760

[56] References Cited

U.S. PATENT DOCUMENTS

| | | | |
|---|---|---|---|
| 4,245,387 | 1/1981 | Reidt | 29/749 |
| 4,386,461 | 6/1983 | Plummer | 29/749 |
| 4,519,129 | 5/1985 | Caveney et al. | 29/749 |
| 4,667,398 | 5/1987 | Leiby | 29/749 |
| 4,709,473 | 12/1987 | Shields | 29/749 |
| 4,825,530 | 5/1989 | Komuro | 29/749 X |

*Primary Examiner*—Carl E. Hall

*Attorney, Agent, or Firm*—Louis A. Hecht; Charles S. Cohen; A. A. Tirva

[57] ABSTRACT

A modular press tool is provided for assembling an electrical connector assembly which includes a modular rear housing component and a mateable modular front housing component defining a front-to-rear axis, and for terminating terminals in the connector assembly in response to mating of the housing components in the direction of the axis. The housing components are capable of being in different sizes and termination configurations. The modular press tool includes a base, and an anvil projecting from the base for positioning a rear housing component of the electrical connector assembly. Interchangeable tooling are mountable on the anvil for accommodating modular rear housing components of different sizes and termination configurations. A ram is movably mounted on the base for movement toward and away from the anvil. The ram is engageable with a front housing component of the electrical connector assembly and includes interchangeable tooling for accommodating modular front housing components of different sizes and termination configurations.

18 Claims, 4 Drawing Sheets

FIG.3
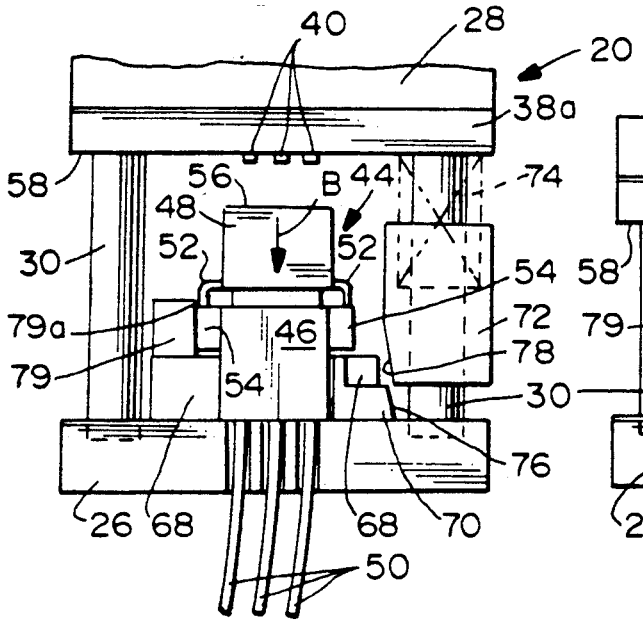
FIG.4
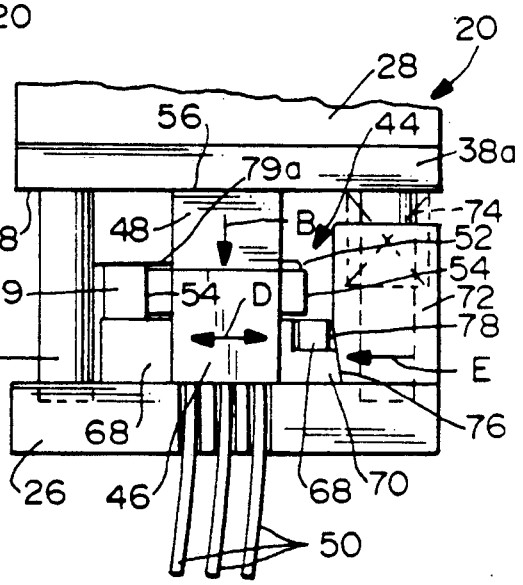
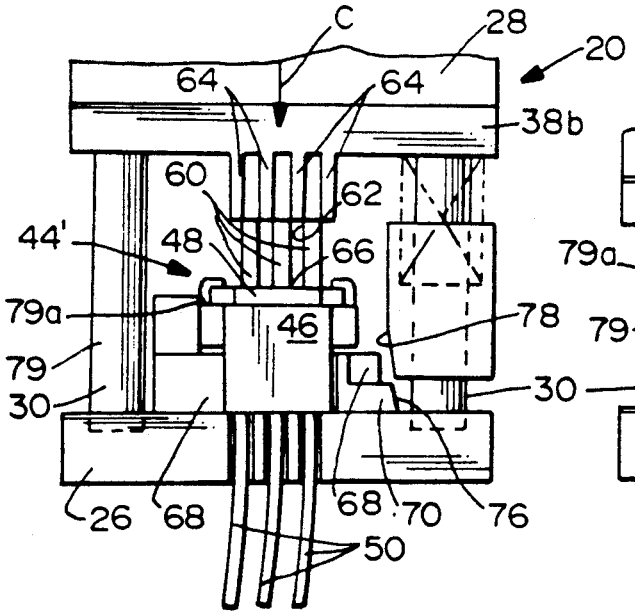
FIG.5
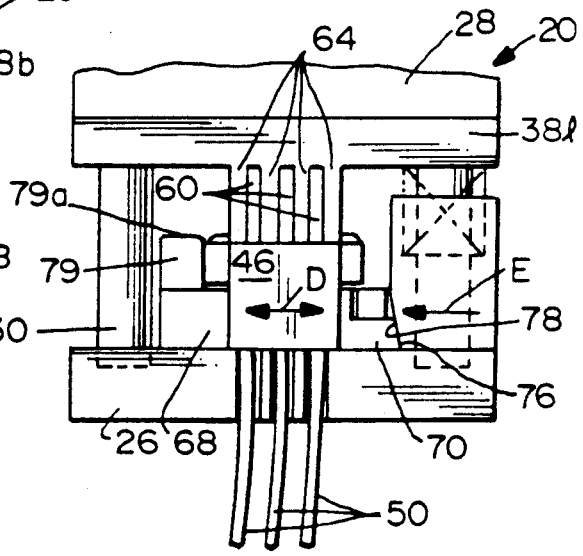
FIG.6

MODULAR PRESS TOOL FOR ASSEMBLING AND TERMINATING ELECTRICAL CONNECTORS

FIELD OF THE INVENTION

This invention generally relates to the art of termination tools for electrical connectors and, particularly, to a modular press tool for assembling electrical connectors of different sizes and termination configurations.

BACKGROUND OF THE INVENTION

Multi-conductor electrical connectors have been used for many years and have been provided in a wide variety of configurations for mass terminating a plurality of terminals to the conductors of a multi-conductor electrical cable. One of the problems in mass termination of these types of connectors is that a given connector of a particular construction can be used with a variety of different circuitry having a different array or configuration of terminals. Consequently, termination tools for assembling or terminating such connectors constantly have to be modified to accommodate the configuration of terminals.

For example, U.S. Pat. No. 4,955,816 to Roberts et al., dated Sept. 11, 1990 and assigned to the assignee of this invention, discloses an electrical connector system which includes self-terminating pin and socket terminals which have forward mating ends and identical rear wire-receiving ends. The wire-receiving ends are mountable in a modular rear housing. The modular rear housing is mateable with either a front plug housing or a front receptacle housing. The terminals can be mass terminated by inserting a plurality of wires into the modular rear housing and by axially advancing the modular rear housing toward the front housing of the system. The housing components can be readily separated from one another for repair or replacement of terminals. Selected connectors can be lockingly mountable to panels and can be lockingly mateable with one another.

U.S. Pat. No. 4,512,619 to Dechelette, dated Apr. 23, 1985 and assigned to the assignee of this invention, discloses a collapsible insulation displacement terminal, responsive to a force directed along the length of a wire received in the terminal. The terminal is particularly useful for use with the electrical connector system shown in the U.S. Pat. No. 4,955,816.

With such an electrical connector system and insulation displacement terminal as disclosed in the above patents, different arrays or configurations of terminals can be used with the same modular connector system. For instance, the array of terminals and terminated conductors can range from a two-conductor circuit to a fifteen-conductor circuit, using the same modular components. Since the system is readily applicable for mass termination operations, termination tooling also must be provided which is readily changeable to accommodate the modular/varying capabilities of the connector system itself. This invention is directed to solving the above problems by providing a modular press tool which, itself, can be readily changed to accommodate the modular characteristics of the connector system.

SUMMARY OF THE INVENTION

An object, therefore, of the invention is to provide a modular press tool for assembling and/or terminating an electrical connector assembly having varying circuit capabilities.

For exemplary purposes, an electrical connector assembly is contemplated which, generally, includes a modular rear housing component and a mateable modular front housing component defining a front-to-rear axis, for terminating terminals in the connector assembly in response to mating of the housing components in the direction of that axis. The housing components are capable of different termination configurations. In order to facilitate a description of the present invention, U.S. Pat. Nos. 4,512,619 and 4,955,816 are incorporated herein by reference, for further details of the electrical connector system and collapsible insulation displacement terminal shown therein.

This invention contemplates a modular press tool which includes a base, with an anvil projecting from the base. The anvil positions the rear housing component of the electrical connector assembly and includes interchangeable tooling for accommodating modular rear housing components of different termination configurations. A ram is movably mounted on the base for engaging the front housing component of the electrical connector system. The ram also includes interchangeable tooling for accommodating modular front housing components of different termination configurations. Means are provided for moving the ram and a positioned front housing component toward the anvil and a positioned rear housing component in the direction of the front-to-rear axis for mating the housing components and terminating the terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

FIG. 3 is a top plan view of the tool, adapted as in FIG. 1, in a loading position;

FIG. 4 is a view similar to that of FIG. 3, with the tool in a terminating position;

FIG. 5 is a top plan of the tool, adapted as in FIG. 2, in a loading position;

FIG. 6 is a view similar to that of FIG. 5, with the tool in a terminating position;

FIGS. 9A–10B are views similar to that of FIG. 9, but showing different interchangeable tooling on the anvil.

DETAILED DESCRIPTION OF THE PREFERRED EMBODIMENT

Figure 1:
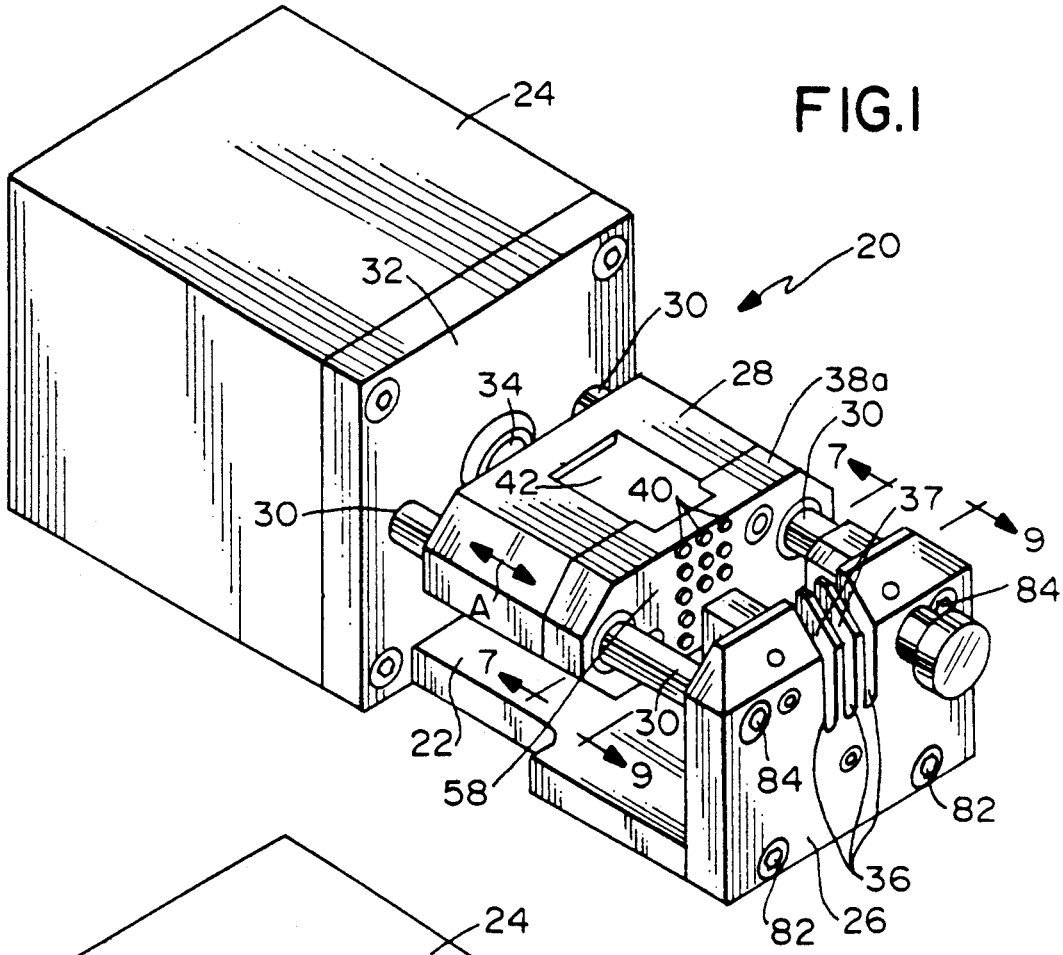
FIG. 1 is a perspective view of a modular press tool incorporating the concepts of the invention and adapted for assembling and terminating a receptacle connector.

Referring to the drawings in greater detail, and first to FIGS. 1 and 2, a modular press tool, generally designated 20, is illustrated for assembling electrical connector assemblies which include modular components, as described hereinafter, and for terminating terminals in the connector assembly in response to mating of the components.

More particularly, modular press tool 20 includes a base 22 projecting forwardly from a pneumatic piston and cylinder device 24. An anvil 26 projects upwardly from base 22 at the forward end thereof, the right-hand end as viewed in FIGS. 1 and 2. A ram 28 is slidably mounted on guide rods 30 which extend between anvil 26 and a front plate 32 of piston and cylinder device 24. A piston rod 34, of the pneumatic piston and cylinder device 24, extends through front plate 22 and is fixed to ram 28 for moving the ram in the direction of double-headed arrow "A".

Figure 2:
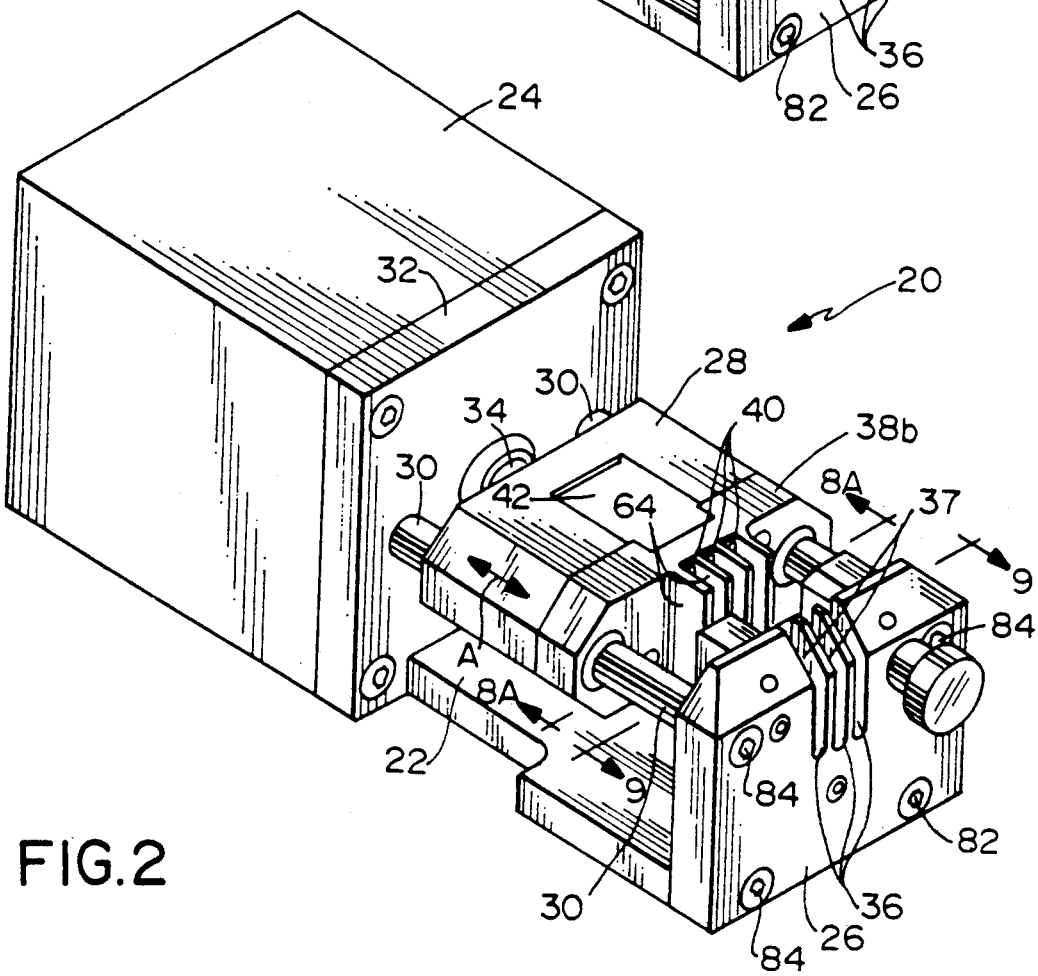
FIG. 2 is a perspective view of the press tool, adapted for assembling and terminating a plug connector.

As seen in FIGS. 1 and 2, anvil 26 is provided with a plurality of slots 36 defined by ribs 37 (three are shown) and into which electrical wires can be located, as described in greater detail hereinafter. In comparing FIGS. 1 and 2, a modular press plate 38*a* (FIG. 1) or 38*b* (FIG. 2) is mounted to the front of ram 28 for engaging a front housing component of an electrical connector assembly. Again, as described in greater detail hereinafter, modular press plate 38*a* is configured for engaging a front housing component of a receptacle connector assembly, and press plate 38*b* (FIG. 2) is configured for engaging a front housing component of a plug connector assembly.

Figure 7:
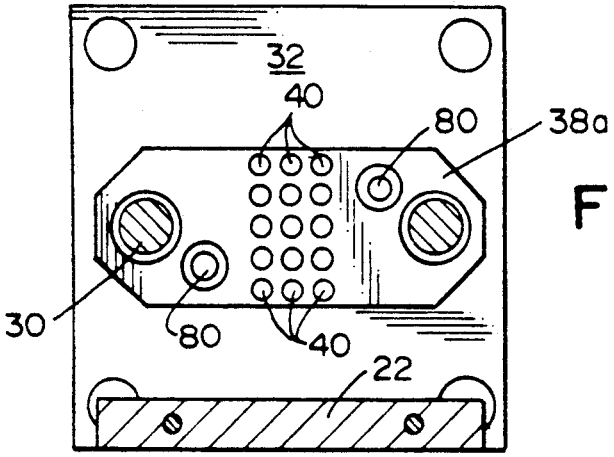
FIG. 7 is a vertical section taken generally along line 7—7 of FIG. 1.
Figure 8A:
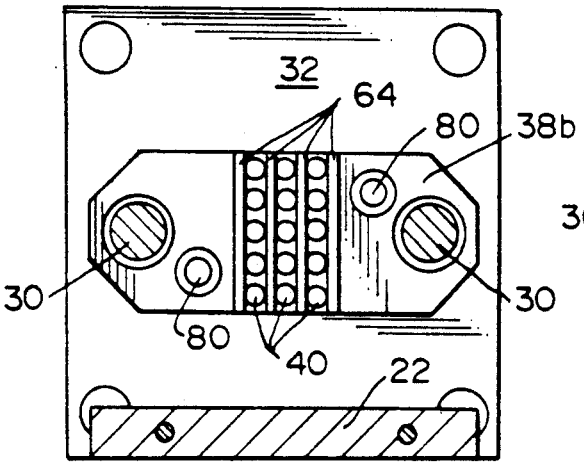
FIG. 8A is a vertical section taken generally along line 8A—8A of FIG. 2.

As seen in both FIGS. 1 and 2, both press plates 38*a* and 38*b* have an array of contacts 40 which are coupled to test circuitry within a holder 42 mounted within ram 28. Conductors (not shown) are attached to such circuitry and extend out of ram 28 to complete the circuit with the free ends (not shown) of wires 50 (FIG. 3) to test the electrical continuity through the terminated contacts within an electrical connector assembly after termination. The embodiments shown in FIGS. 7–8D show a total of fifteen contacts 40 although it is understood that other configurations can be used provided there is no one contact for each terminal to be tested.

Referring to FIGS. 3 and 4 in conjunction with FIG. 1, an electrical connector assembly, generally designated 44, is illustrated as located between anvil 26 and press plate 38*a* of ram 28 prior to termination. The connector assembly shown is of the modular-type illustrated in U.S. Pat. No. 4,955,816 described above. The connector assembly includes a rear housing component 46 and a front housing component 48. Terminals are mounted within rear housing component 46 for insulation-displacement termination with the conductors of electrical wires 50. Latch arms 52 project outwardly from front housing component 48 for latching engagement in latch devices 54 on rear housing component 46, in response to movement of the front housing component in the direction of arrow "B" (FIG. 3). Further details of connector assembly 44 can be derived from the aforesaid U.S. Pat. No. 4,955,816. Front housing component 48 of electrical connector assembly 44 is a receptacle component having a generally planar front face 56 for engaging the flat face 58 of press plate 38*a*.

When ram 28 is moved toward anvil 26 in the direction of arrow "B" (FIG. 3), flat face 58 of press plate 38*a* engages planar surface 56 of front receptacle housing component 48 and drives the front housing component into assembly with rear housing component 46 as seen in FIG. 4. As can be seen in U.S. Pat. No. 4,955,816, the terminals within rear housing component 46 are effectively terminated to the conductors of electrical wires 50 by an insulation displacement process in response to an actuating force directed along the axes of the wires. Therefore, as front housing component 48 is moved towards rear housing component 46, the insulation displacement terminals within rear housing component 46 are terminated to wires 50.

FIGS. 5 and 6 are substantially identical to FIGS. 3 and 4, except that front housing component 48' of an electrical connector assembly 44' now comprises a plug connector component for assembly to modular rear housing component 46. It can be seen that the plug connector component includes a plurality of silos 60 defining terminal receiving bore-like cavities. The silos are spaced apart defining slots 62 therebetween. Referring to FIG. 2 in conjunction with FIGS. 5 and 6, press plate 38*b* on ram 28 has a plurality of ribs 64 which project into slots 62 between silos 60 for engaging a flat surface 66 at the base of the silos. Otherwise, like numerals have been applied in FIGS. 5 and 6 to identify like components described in relation to FIGS. 3 and 4. Therefore, just as with the above description of the operation of the press tool in relation to FIGS. 3 and 4, when ram 28 is moved in the direction of arrow "C" (FIG. 5), the distal ends of ribs 64 engage surface 66 on plug connector component 48 and move the connector component into an assembled condition relative to modular rear housing component 46 and, at the same time, terminate the terminals within the rear housing component to the conductors of wires 50.

From the foregoing, it can be seen that modular press tool 20 can assemble and terminate either a receptacle connector assembly 44 (FIGS. 3 and 4) or a plug connector assembly 44' (FIGS. 5 and 6) simply by changing the configuration of press plates 38*a* and 38*b* on the front of ram 28.

The invention also contemplates providing means on modular press tool 20 for laterally supporting the outside walls of modular rear housing component 46 during an assembly and termination operation. More particularly, with the insulation displacement terminals and electrical connector assemblies shown in the aforementioned U.S. Pat. Nos. 4,515,619 and 4,955,816, the terminals are terminated to the electrical wires by an actuating force directed along the axes of the terminals. This may result in outward forces on the walls of modular rear housing component 46 in the direction of double-headed arrows "D" (FIGS. 4 and 6).

In order to laterally support modular rear housing component 46, and referring again to FIGS. 3–6, a fixed nesting plate 68 is mounted to anvil 26, and a movable clamping member 70 is slidably mounted to the anvil. A cam member 72 is slidably mounted on one of the guide rods 30 and is biased in the direction of arrow "B" (FIG. 3) by means of a spring 74 surrounding the guide rod and sandwiched between cam member 72 and press plate 38*a* (or 38*b* in FIG. 5). Complementary interengaging wedge surfaces 76 and 78 are provided on movable clamping member 70 and cam member 72, respectively, for engagement when ram 28 is moved toward anvil 26. When so moved, surfaces 76 and 78 engage and move the movable clamping member 70 in the direction of arrows "E" (FIGS. 4 and 6) to position the movable clamping member into engagement with the side of modular rear housing component 46 opposite fixed nesting plate 68. Therefore, during the assembly and termination operation, nesting plate 68 and clamping member 70 support the outside walls of modular rear housing component 46 against the termination forces directed outwardly in the direction of double-headed arrow "D" (FIGS. 4 and 6).

FIGS. 3–6 also show a retaining member 79 having a projecting flange 79*a* overlying a corner of rear housing component 46. The retaining member helps to retain the rear housing component against anvil 26.

FIGS. 7 and 8A–8D illustrate various configurations of modular press plates for mounting on the forward face of ram 28 and for engaging different front housing components of electrical connectors of different configurations. These press plates all are interchangeable to enable use of modular press tool 20 with a variety of connector assemblies. More particularly, FIG. 7 shows the configuration of press plate 38*a* already described in relation to FIGS. 1, 3 and 4. In the illustrated embodiment of the invention, the press tool and its modularized components are shown capable of assembling connector assemblies having a maximum of fifteen terminals arranged in three rows of five terminals, as can be seen in FIG. 7. However, it should be understood that the invention can be incorporated in press tools for assembling and terminating other numbers of terminals in connector assemblies of different configurations. With the array of terminals illustrated, press plate 38*a* shown in FIG. 7 would be used on the press tool to assemble and terminate receptacle connector assemblies having a front receptacle housing component 48 (FIGS. 3 and 4) regardless of the number of terminals and the corresponding lateral configuration of the connector assembly. This is because, as seen in FIGS. 3 and 4, all of the front receptacle housing components will have a planar face 56 (FIGS. 3 and 4) for engagement by the flat face 58 of press plate 38.

However, when assembling and terminating plug connector assemblies, such as plug connector assembly 44' including front plug housing component 48' described in relation to FIGS. 5 and 6, different configurations of press plates would be used. For instance, FIG. 8A shows press plate 38*b* (FIGS. 2, 5 and 6) having four ribs 64 extending the full length of the three rows of five terminals. This press plate would be used with a connector assembly which has a full compliment of fifteen terminals.

Figure 8B:
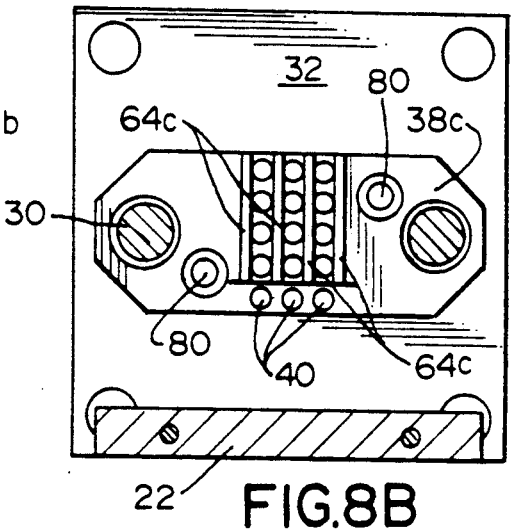
FIGS. 8B–8D are views similar to that of FIG. 8A, but showing different modular press plates on the forward face of the ram.
Figure 8C:
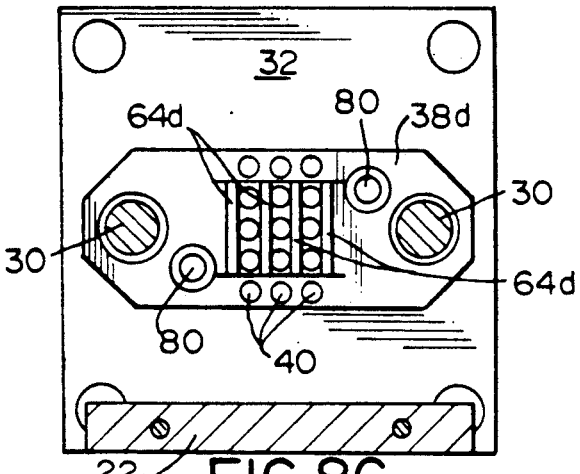
Figure 8D:
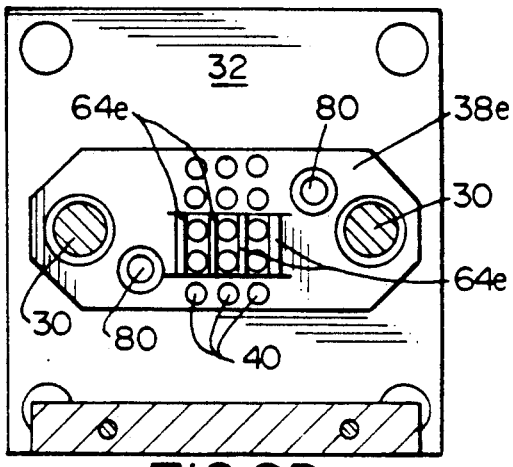

Comparing FIGS. 8A–8D, examples of different configurations of the press plates on ram 28 are illustrated to exemplify the interchangeable tooling on the ram for accommodating modular front plug housing components of different termination configurations. More particularly, as stated, FIG. 8A shows press plate 38*b* as illustrated in FIG. 2 wherein ribs 64 extend the entire height of the press plate. Turning to FIG. 8B, it can be seen that a press plate 38*c* is provided wherein ribs 64*c* do not extend the entire width of the press plate. This press plate is designed to terminate electrical connector assemblies which have either four or twelve contacts.

FIG. 8C shows a press plate 38*d* having still shorter ribs 64*d* centered in the middle of the press plate. This press plate is designed to accommodate front plug housing components having either three or nine contacts.

FIG. 8D shows still another press plate 38*e* having still shorter ribs 64*e*, and this press plate is provided for accommodating front plug housing components having either two or six contacts.

In all of the configurations of ribs 64–64*e*, generally the peripheral bounds of the ribs are the same as the outside bounds or sizes of the front plug housing components which are being assembled.

In all of the instances of the different press plates 38*a–*38*e* shown in FIGS. 7 and 8A–8D, the press plates are mounted to ram 28 by means of bolts 80 whereby the press plates are readily interchangeably mountable to the forward face of the ram. In order to interchange the press plates, and referring back to FIGS. 1 and 2, a pair of bolts 82 are threaded into one edge of base 22 and a second pair of bolts 84 are threaded into the distal ends of guide rods 30 to hold anvil 26 securely in position. These bolts simply are removed, the anvil is temporarily removed and the press plates can be interchanged.

Bolts 80 are removed to free the press plate from ram 28 and then the press plate is simply slid over guide rods 30 and removed. A different press plate is slid onto the guide rods and the press mechanism is reassembled.

Figure 9:
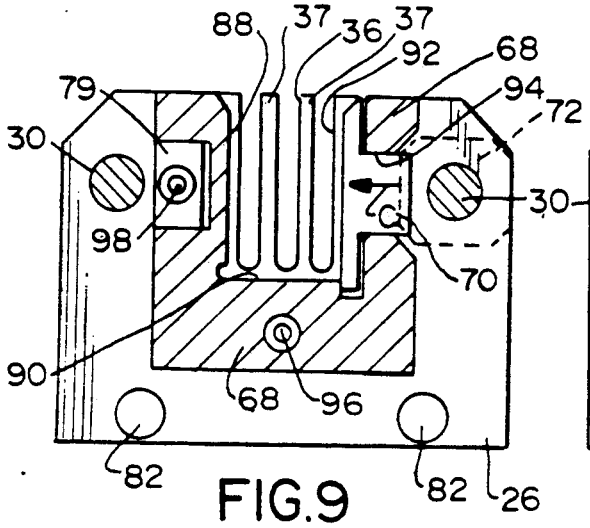
FIG. 9 is a vertical section taken generally along line 9—9 of FIG. 1.
Figure 10:
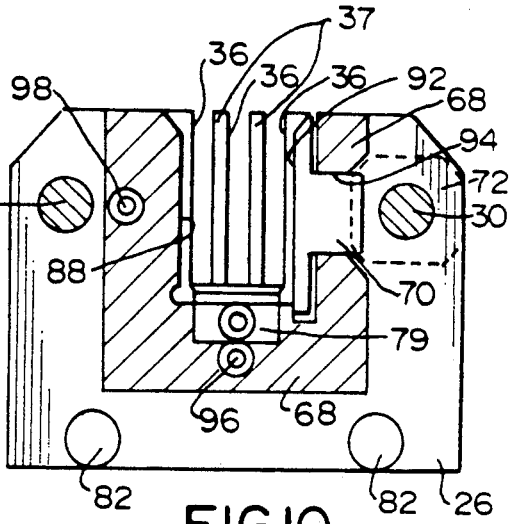
Figure 10A:
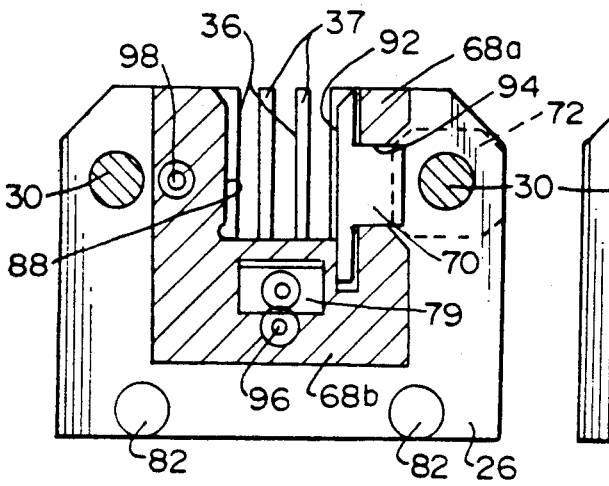
Figure 10B:
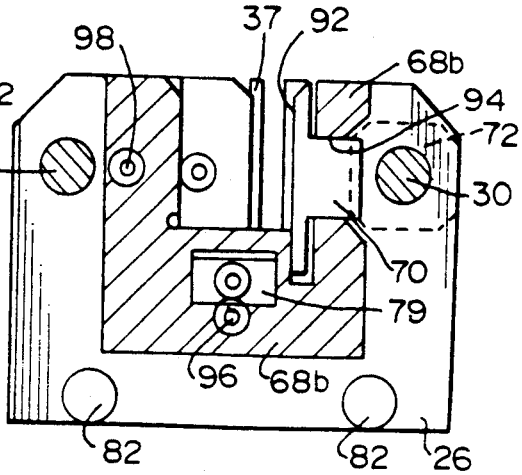

FIGS. 9–10B illustrate examples of different interchangeable tooling mountable on anvil 26 for accommodating modular rear housing components of different termination configurations and/or sizes. More particularly, FIG. 9 shows nesting plate 68 for receiving a rear housing component which contains fifteen contacts for assembly to a front plug housing component which is engaged by press plate 38*b* described in relation to FIGS. 2 and 8A. Nesting plate 68 has a side wall 88 and a bottom wall 90 defining two sides of a recess for receiving the rear housing component. Clamping member 70 has a forward face 92 defining a side of the recess opposite wall 88 of nesting plate 68. Cam member 72 is shown in phantom. As stated above, cam member 72 moves clamping member 70 in the direction of arrow "C" to engage the rear housing component in response to movement of ram 28. Consequently, side wall 88 of nesting plate 68 forms an abutment wall against which the rear housing component abuts when clamping member 70 is moved to engage the rear housing component. It can be seen that clamping member 70 is reciprocally movable within slot 94 in nesting plate 68. Retaining member 79 also is shown (see FIGS. 3–6) for holding the rear housing component against the anvil, i.e., against ribs 37. Nesting plate 68 is removably secured to anvil 28 by a bolt 96, and retaining member 79 is secured to nesting plate 68 by a bolt 98.

Figure 9A:
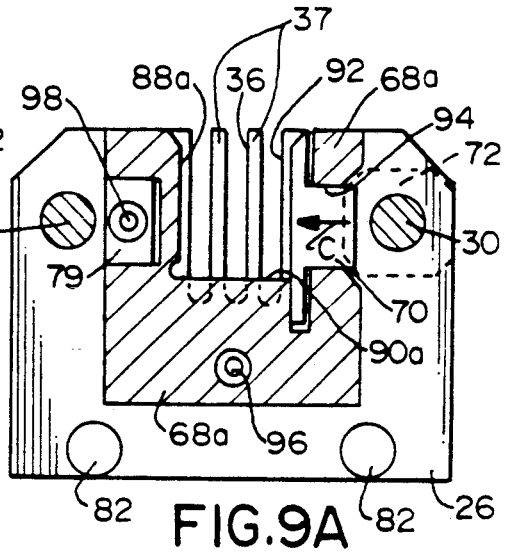

FIG. 9A shows a nesting plate 68*a* having a side wall 88*a* and a bottom wall 90*a* which define a smaller recess for receiving rear housing components which mount either six, nine or twelve contacts. Otherwise, the remaining components of the tooling is the same as shown and described in relation to FIG. 9. For instance, side wall 88*a* defines an abutment wall opposite face 92 of clamping member 70 which is moved in the direction of arrow "C" by cam member 72. Retaining member 79 is held in the same position as described in relation to FIG. 9 by means of bolt 98.

Figure 9B:
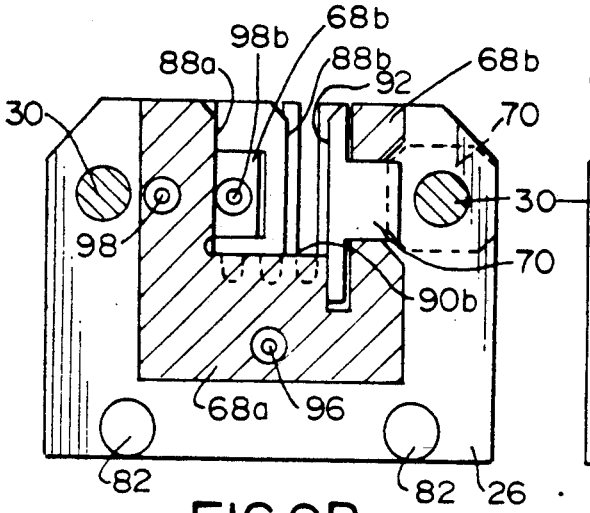

FIG. 9B shows the interchangeable tooling configured to accommodate a modular rear housing component which mounts either two, three or four contacts. With this tooling, nesting plate means are configured to define still a further, smaller recess by means of a bottom wall 90*b* and a side abutment wall 88*b* of a nesting filler plate 68*b* inside nesting plate 68*a*. The filler plate is appropriately secured against abutment wall 88*a* of nesting plate 68*a*, as by bolts. Clamping member 70 again is mounted as described in relation to FIGS. 9 and 9A, with face 92 opposite abutment wall 88*b* of nesting plate 68*b*. However, retaining member 79 has been moved inwardly toward the smaller recess and is mounted to nesting filler plate 68*b* by a bolt 98*b*.

Whereas FIGS. 9-9B show examples of interchangeable tooling for nesting modular rear housing components on anvil 26 which are assembled to front plug housing components as described in relation to FIGS. 2, 5 and 6, FIGS. 10-10B illustrate interchangeable tooling for modular rear housing components which are assembled to front receptacle housing components such as described in relation to FIGS. 1, 3 and 4. More particularly, in comparing FIGS. 10, 10A and 10B with FIGS. 9, 9A and 9B, respectively, it can be seen that respectively identical nesting plates 68, 68*a* and 68*b* are utilized. However, it can be seen that the location of retaining member 79 has been moved to a position at the bottom of the nesting plates versus the sides of the nesting plates as illustrated in FIGS. 9-9B. Moving the location of the retaining member is necessary because of differences in the outside configurations of the receptacle housing components versus the plug housing components. Otherwise, the nesting plates still perform the function of providing a recess of a particular size for receiving a particular modular connector component and provide an abutment opposing the forces of clamping member 70.

It should be understood from the foregoing description that the interchangeable tooling on ram 28 as described in relation to FIGS. 7-8B and the interchangeable tooling on anvil 26 as described in relation to FIGS. 9-10B, are examples of interchangeable tooling which might be used in assembling and terminating electrical connector assemblies as disclosed in U.S. Pat. Nos. 4,512,619 and 4,955,816 which have been incorporated herein by reference. However, the invention contemplates a modular press tool for assembling other electrical connector assemblies wherein relatively movable tool components, such as ram 28 and anvil 26, can be provided with a wide variety of interchangeable tooling to thereby provide a modular press tool for assembling and terminating modular connector assemblies.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A modular press tool for assembling an electrical connector assembly which includes a rear housing component and a mateable front housing component defining a front-to-rear axis and for simultaneous mass termination of terminals in the connector assembly as a result of mating of the housing components in the direction of said axis, said terminals being located within a plurality of terminal receiving apertures, each oriented parallel to said front-to-rear axis, the housing components being capable of different termination configurations, said press tool comprising:

a base;

an anvil projecting from the base for positioning a rear housing component of the electrical connector assembly and including interchangeable tooling for accommodating rear housing components of different termination configurations, said anvil including comb means having a plurality of slots through which wires projecting from the rear of the rear housing component extend, said comb means being positioned so that an axis through each said aperture extends through an associated one of said slots;

a ram movably mounted on the base for movement parallel to said front-to-rear axis and for engaging a front housing component of the electrical connector assembly and including interchangeable tooling for accommodating front housing components of different termination configurations; and means for moving the ram and a positioned front housing component toward the anvil and a positioned rear housing component parallel to said axis for mating the housing components and terminating the terminals.

2. The modular press tool of claim 1 wherein said interchangeable tooling on the ram include a plurality of press plates of different configurations mountable on a front face of the ram.

3. The modular press tool of claim 2 wherein said press plates are provided with different configurations of parallel ribs for engaging plug connector components having difficult configurations of terminal receiving silos arranged in rows, the ribs projecting between the rows.

4. The modular press tool of claim 1 wherein said interchangeable tooling on the anvil include a plurality of nesting plates interchangeably mountable on the anvil and having recess means of different configurations for nesting the rear housing components of different termination configurations.

5. The modular press tool of claim 4 wherein the recess means of each of said nesting plates is in registry with at least a portion of the comb means.

6. The modular press tool of claim 4 wherein said recess means of each of said nesting plates include an abutment wall for engaging one side of the respective rear housing component and clamp means for engaging an opposite side of the rear housing component to support opposite sides of the rear housing component transversely of said axis.

7. The modular press tool of claim 6 including means movably mounting said clamp means on the anvil.

8. The modular press tool of claim 7 wherein said clamp means are located in the path of movement of said ram, and including means operatively associated with the ram for moving the clamp means into engagement with said opposite side of the rear housing component in response to movement of the ram toward the anvil.

9. The modular press tool of claim 1, including abutment means mounted on the anvil for engaging one side of a respective modular rear housing component and clamp means for engaging an opposite side of the rear housing component to support opposite sides of the rear housing component transversely of said axis.

10. The modular press tool of claim 9 including means movably mounting said clamp means on the anvil.

11. The modular press tool of claim 10 wherein said clamp means are located in the path of movement of said ram, and including means operatively associated with the ram for moving the clamp means into engagement with said opposite side of the rear housing component in response to movement of the ram toward the anvil.

12. A modular press tool for assembling an electrical connector assembly which includes a rear housing component and a mateable front housing component which can be either a plug connector component or a receptacle connector component, and for terminating terminals in the connector assembly as a result of mating of the housing components, said terminals being located within a plurality of terminal receiving apertures, the axes of said apertures being generally parallel, the housing components being capable of different sizes and terminal configurations, said press tool comprising:

a base;

an anvil on the base, said anvil including comb means having a plurality of slots through which wires projecting from the rear of the rear housing component extend, said comb means being positioned with said rear housing components so that the axis of each said aperture projects through an associated one of said slots;

a ram movably mounted on the base for movement generally parallel to said axes;

means for moving the ram toward and away from the anvil in a direction generally parallel to said axes;

first interchangeable tooling interchangeably mountable on the ram for engaging various sizes and terminal configurations of front housing components; and second interchangeable tooling interchangeably mountable on the anvil for positioning various sizes and terminal configurations of modular rear housing components.

13. The modular press tool of claim 12 wherein said interchangeable tooling on the ram including a plurality of press plates of different configurations mountable on a front face of the ram.

14. The modular press tool of claim 13 wherein said press plates are provided with different configurations of parallel ribs for engaging plug connector components having different configurations of terminal receiving silos arranged in rows, the ribs projecting between the rows.

15. The modular press tool of claim 12 wherein said interchangeable tooling on the anvil include a plurality of nesting plates interchangeably mountable on the anvil and having recess means of different configurations for nesting the rear housing components of different termination configurations.

16. The modular press tool of claim 15 wherein the recess means of each of said nesting plates is in registry with at least a portion of the comb means.

17. A press tool for assembling an electrical connector assembly which includes a first housing component and a mateable second housing component and for simultaneous mass termination of a plurality of terminals within the connector assembly as a result of mating of the housing components to a portion of a wire located within each terminal, each said portion defining an axis, said press tool comprising:

a base;

an anvil secured to said base for positioning said first housing component of the electrical connector prior to termination of said terminals, said anvil including comb means having a plurality of slots through which wires projecting from the rear of the first housing component extend, said comb means being positioned so that each said axis extends through an associated one of said slots;

a ram movably mounted on said base for reciprocal movement parallel to each said axis to engage the second housing component and mate the first and second housing components thereby terminating each terminal to an individual conductor; and moving means for moving said ram a predetermined distance parallel to each said axis.

18. The press tool of claim 17 further comprising clearance means to permit said press tool to simultaneously mass terminate at least three parallel rows of at least two terminals which are contained within said electrical connector.

* * * * *